US009080461B2

(12) United States Patent
Ivakitch et al.

(10) Patent No.: US 9,080,461 B2
(45) Date of Patent: Jul. 14, 2015

(54) FAN AND BOOST JOINT

(75) Inventors: Richard Ivakitch, Toronto (CA); Andreas Eleftheriou, Woodbridge (CA); Philippe Bonniere, Toronto (CA)

(73) Assignee: PRATT & WHITNEY CANADA CORP., Longueuil, Quebec (CA)

( * ) Notice: Subject to any disclaimer, the term of this patent is extended or adjusted under 35 U.S.C. 154(b) by 631 days.

(21) Appl. No.: 13/364,379

(22) Filed: Feb. 2, 2012

(65) Prior Publication Data

US 2013/0202442 A1 Aug. 8, 2013

(51) Int. Cl.

| | |
|---|---|
| ***F01D 25/00*** | (2006.01) |
| ***F01D 21/04*** | (2006.01) |
| ***F01D 5/06*** | (2006.01) |

(52) U.S. Cl.

CPC ..... *F01D 21/04* (2013.01); *F01D 5/066* (2013.01); *F01D 21/045* (2013.01); *Y10T 29/49318* (2015.01)

(58) Field of Classification Search

CPC ..... F01D 21/04; F01D 5/066; F01D 21/045; Y10T 29/49318

USPC ..... 415/216.1; 416/210 A, 194, 244 R, 9

See application file for complete search history.

(56) References Cited

U.S. PATENT DOCUMENTS

| | | | | |
|---|---|---|---|---|
| 4,313,712 | A | 2/1982 | Briggs | |
| 4,375,906 | A | 3/1983 | Roberts et al. | |
| 4,452,567 | A | 6/1984 | Treby et al. | |
| 4,744,214 | A | 5/1988 | Monsarrat et al. | |
| 4,934,140 | A | 6/1990 | Dennison et al. | |
| 5,433,584 | A | 7/1995 | Amin et al. | |
| 5,791,789 | A | 8/1998 | Van Duyn et al. | |
| 5,974,782 | A | 11/1999 | Gerez | |
| 6,082,959 | A | 7/2000 | Van Duyn | |
| 6,109,022 | A * | 8/2000 | Allen et al. | 60/223 |
| 6,240,719 | B1 | 6/2001 | Vondrell et al. | |
| 6,325,546 | B1 * | 12/2001 | Storace | 384/536 |
| 6,428,269 | B1 * | 8/2002 | Boratgis et al. | 415/9 |
| 6,622,473 | B2 * | 9/2003 | Becquerelle et al. | 60/226.1 |
| 6,783,319 | B2 * | 8/2004 | Doerflein et al. | 415/1 |
| 7,153,091 | B2 | 12/2006 | Stephenson et al. | |
| 7,404,678 | B2 | 7/2008 | Plona | |
| 7,458,773 | B2 | 12/2008 | Brault et al. | |
| 7,524,112 | B2 | 4/2009 | Gerez et al. | |
| 8,209,952 | B2 | 7/2012 | Ress, Jr. | |
| 8,225,593 | B2 | 7/2012 | Le Hong et al. | |
| 8,646,978 | B2 * | 2/2014 | Jadczak et al. | 384/99 |
| 2011/0206498 | A1 | 8/2011 | McCooey | |
| 2014/0026591 | A1 * | 1/2014 | Denis et al. | 60/796 |

* cited by examiner

*Primary Examiner* — Dwayne J White
*Assistant Examiner* — Jason Fountain
(74) *Attorney, Agent, or Firm* — Norton Rose Fulbright Canada LLP

(57) ABSTRACT

A gas turbine engine having at least one spool assembly, the at least one spool assembly including a fan rotor, a compressor disposed downstream of the fan rotor, a turbine and a shaft connecting the fan rotor, compressor and turbine, a joint affixed to an upstream end of the shaft, and including a first link connecting the fan rotor to the shaft and a second link connecting the compressor to the shaft, the second link being less rigid then the first link.

16 Claims, 2 Drawing Sheets

FAN AND BOOST JOINT

TECHNICAL FIELD

The described subject matter relates generally to gas turbine engines, and more particularly, to a fan and boost joint.

BACKGROUND OF THE ART

Aircraft gas turbine turbofan engines generally include a low pressure spool assembly having a fan rotor, low pressure compressor and a low pressure turbine connected by a low pressure spool shaft, and a high pressure spool assembly having a high pressure compressor and a high pressure turbine connected by a high pressure spool shaft which is hollow and disposed coaxially around the low pressure spool shaft. Conventionally, the fan rotor and the low pressure compressor, particularly a boost stage which is positioned upstream of the low pressure compressor, are tied together on the low pressure spool shaft, for example by a spline and a spigot arrangement. During flight, a bird strike event and other blade-off loads which create imbalanced loads to the fan rotor, may cause a fan rotor deflection. The fan rotor deflection may be transmitted downstream to the boost stage of the low pressure compressor to cause the boost stage to move with the fan rotor deflection, due to the fact that they are tied together on the low pressure spool shaft. The boost stage deflection affects tip clearance on the boost stage of the low pressure compressor, thereby further affecting the performance of the gas turbine engine.

Accordingly, there is a need to provide an improved fan rotor and boost compressor joint in aircraft gas turbine engines.

SUMMARY

In one aspect, the described subject matter provides a gas turbine engine having at least one spool assembly, the at least one spool assembly comprising a fan rotor, a compressor disposed downstream of the fan rotor, a turbine and a shaft connecting the fan rotor, compressor and turbine, a joint affixed to an upstream end of the shaft, the joint including a first link connecting the fan rotor to the shaft and a second link connecting the compressor to the shaft, the second link being less rigid than the first link wherein the first link comprises an annular front leg extending generally radially outwardly from the shaft, and wherein the second link comprises an annular rear leg extending generally radially outwardly from the shaft.

In another aspect, the described subject matter provides a gas turbine engine having at least one spool assembly, the at least one spool assembly comprising a fan rotor, a compressor disposed downstream of the fan rotor, a turbine and a shaft connecting the fan rotor, compressor and turbine, means affixed to an upstream end of the shaft for connecting the fan rotor to the shaft in a first link and for connecting the compressor to the shaft in a second link, the second link being less rigid than the first link.

In a further aspect, the described subject matter provides a method for disassociating a fan rotor deflection from a compressor deflection during an undue imbalance event of a fan rotor in a gas turbine engine, the method comprising: a) connecting a fan rotor to an engine shaft by a first link, the link frustoconically extending outwardly of an upstream end of the shaft; and b) connecting a compressor to the engine shaft by a second link, the second link frustoconically extending outwardly of the upstream end of the shaft, the second link being less rigid than the first link.

Further details of these and other aspects of the described subject matter will be apparent from the detailed description and drawings included below.

BRIEF DESCRIPTION OF THE DRAWINGS

Reference is now made to the accompanying drawings depicting aspects of the described subject matter, in which.

It will be noted that throughout the appended drawings, like features are identified by like reference numerals.

DETAILED DESCRIPTION

Figure 1:
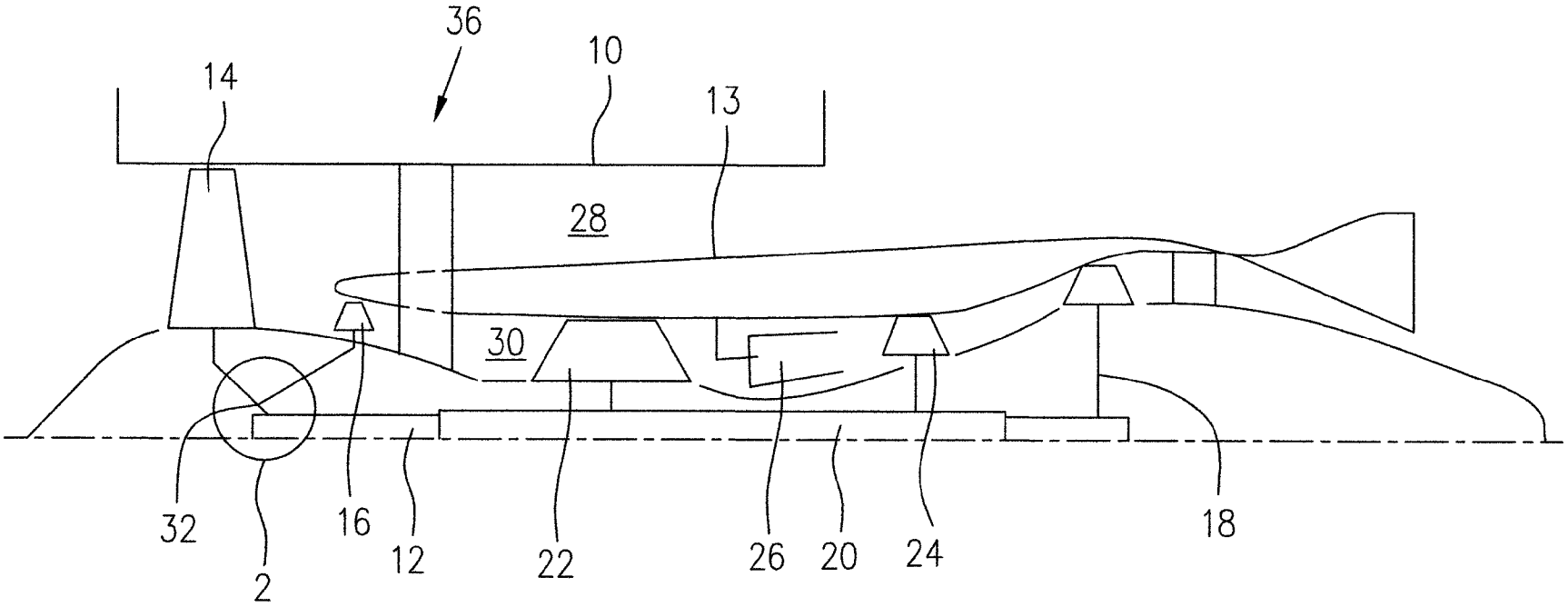
FIG. 1 is a schematic cross-sectional view of a turbofan gas turbine engine, showing one embodiment of the described subject matter.

FIG. 1 illustrates a turbofan gas turbine engine according to one embodiment. The engine includes a housing or nacelle 10, a core casing 13, a low pressure spool assembly (not numbered) which includes a fan rotor 14, a low pressure compressor assembly having a boost compressor 16 and a low pressure turbine assembly 18 connected by a shaft 12, and a high pressure spool assembly (not numbered) which includes a high pressure compressor assembly 22 and a high pressure turbine assembly 24 connected by a turbine shaft 20. The housing or nacelle 10 surrounds the core casing 13 and in combination the housing 10 and the core casing 13 define an annular bypass duct 28 for directing a bypass airflow. The core casing 13 surrounds the low and high pressure spool assemblies to define a core fluid path 30 therethrough. In the core fluid path 30 there is provided a combustor 26 to form a combustion gas generator assembly which generates combustion gases to power the high pressure turbine assembly 24 and the low pressure turbine assembly 20. The boost compressor 16 is disposed downstream of the fan rotor 14 and together with the fan rotor 14, is connected to the shaft 12 via a joint 32, as schematically shown in the circled area 2 and will be further described hereinafter.

The terms "upstream" and "downstream" mentioned in the description below generally refer to the airflow direction through the engine and are indicated by an arrow in FIG. 1. The terms "front" and "rear" generally refer to a position sequence from the front to the rear of the engine in a direction as indicated by the arrow in FIG. 1. The terms "axial", "radial" and "circumferential" used for various components below are defined with respect to the main engine axis shown but not numbered in FIG. 1.

Figure 2:
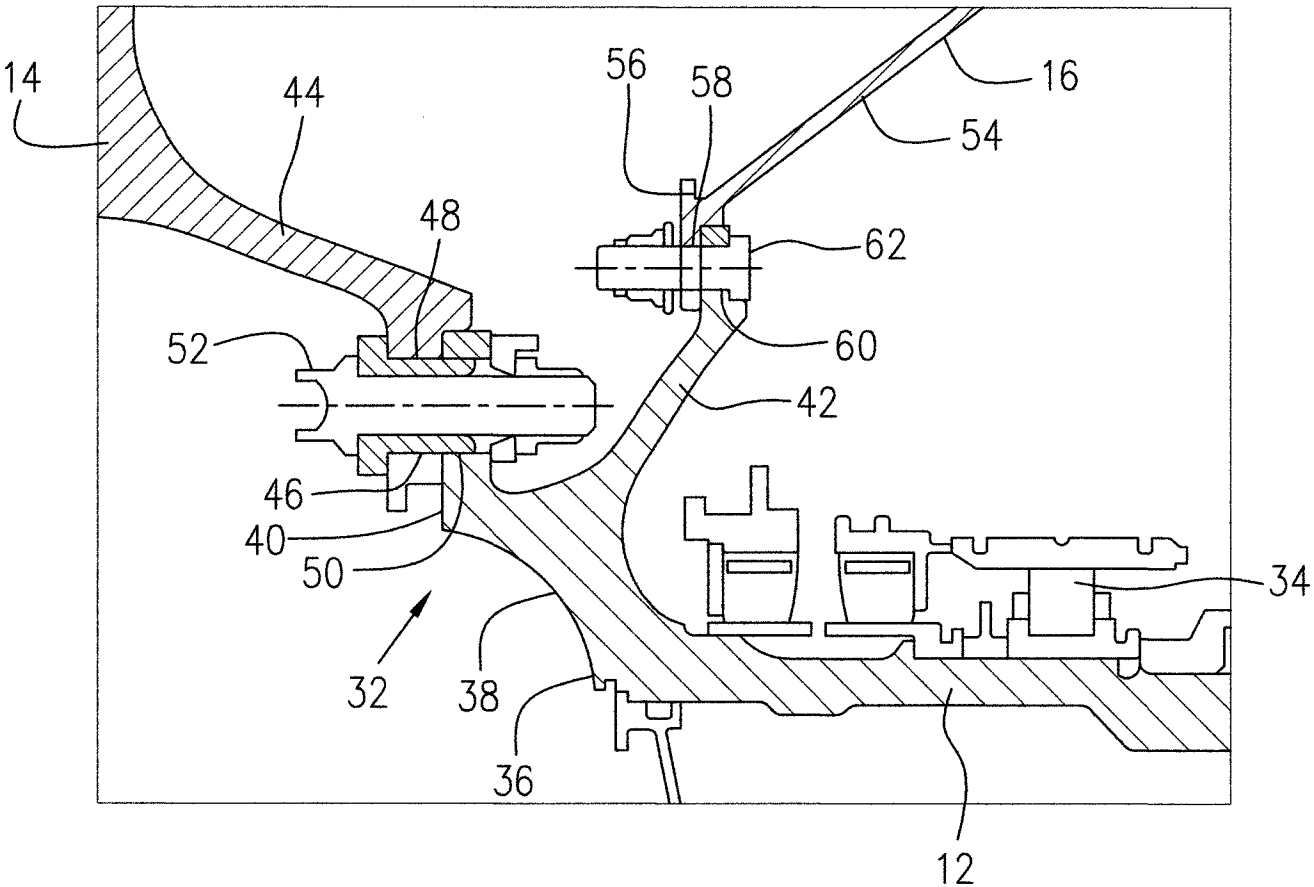
FIG. 2 is a partial cross-sectional view in an enlarged scale, of the circled area 2 of FIG. 1, showing a structural arrangement of one embodiment.

According to one embodiment illustrated in FIGS. 1 and 2, the shaft 12 is supported by a bearing assembly 34 disposed around the shaft 12 adjacent to an upstream end 36 of the shaft 12. The bearing assembly 34 is supported by a stationary structure (not shown) of the engine. The upstream end 36 of the shaft 12 is integrated with the joint 32. The joint 32 according to this embodiment may have an annular joint body 38 extending generally radially outwardly from the upstream end 36 of the shaft 12. An annular front leg 40 extends generally radially and outwardly, from the annular joint body 38 to form a first link for connection with the fan rotor 14. An annular rear leg 42 disposed downstream of the annular front leg 40 and extends generally radially and outwardly from the annular joint body 38 to form a second link for connection with the boost compressor 16. The joint 32 with the annular front and rear legs 40, 42 may expand frustoconically forwardly and rearwardly, respectively, from the annular joint body 38 to form a substantial Y-shaped configuration in a cross-section thereof, as shown in the FIGS. 1 and 2.

The annular front leg 40 may have a thickness greater than the thickness of the annular rear leg 42. The annular front leg 40 may also be shorter than the annular rear leg 42. The annular joint body 38 may have a thickness greater than the thickness of the respective annular front and rear legs 40, 42. Therefore, the joint 32 provides the second link connecting the boost compressor 16 to the shaft 12, less rigid than the first link connecting the fan rotor 14 to the shaft 12. The less rigidity and thus relative flexability of the second link provided by the annular rear leg 42 with respect to the first link provided by the annular front leg 40, reduces transmissibility of deflection through the joint 32 from the fan rotor 14 to the boost compressor 16, thereby substantially maintaining the tip clearance of the boost compressor 16 during a bird ingestion or other blade detachment event occurring to the fan rotor 14.

According to one embodiment, the fan rotor 14 may include a rearwardly and inwardly extending annular web 44 and an annular flange 46 extending radially and inwardly from a rear end (not numbered) of the annular web 44. A plurality of holes 48 may be provided in the flange 46 of the of the fan rotor 14, circumferentially spaced apart one from another. A plurality of holes 50 may be provided in the annular front leg 40, circumferentially spaced apart one from another and aligning with the respective holes 48 in the flange 46 of the fan rotor 14, to receive fasteners or fastener assemblies 52 which extend axially therethrough for securing the fan rotor 14 to the annular front leg 40 of the joint 38. Each of the fastener assemblies 52 may include a fastener, washer, nut, lock element, etc.

According to one embodiment, the boost compressor 16 may include a forwardly and inwardly extending annular web 54 and an annular flange 56, extending radially and inwardly from a front end (not numbered) of the annular web 54. A plurality of holes 58 may be provided in the annular flange 56 of the boost compressor 16, circumferentially spaced apart one from another. A plurality of holes 60 may also be provided in the annular leg 42 adjacent an outer periphery of the annular rear leg 42, circumferentially spaced apart one from another and aligning with the respective holes 58, in order to receive respective fasteners or fastener assemblies 62 which extend axially therethrough for securing the boost compressor 16 to the annular rear leg 42 of the joint 32. Each of the fastener assemblies 62 may include a fastener, washer, nut, lock element, etc.

Optionally, the annular web 44 of the fan rotor 14 may have a thickness greater than the thickness of the annular web 54 of the boost compressor 16, in order to further reduce deflection transmissibility from the fan rotor 14 to the boost compressor 16.

Alternatively, the joint 32 need not necessarily be integrated with the upstream end of 36 of the shaft 12. The joint 32 may be removably connected to the shaft 12 by any known or unknown suitable mechanism.

Alternatively, the annular front leg 40 of the joint 32 may be replaced by three or more front legs extending radially and outwardly from the annular joint body 38, circumferentially spaced apart one from another.

Similarly, the annular rear leg 42 of the joint 32 may be alternatively replaced with three or more rear legs radially and outwardly extending from the annular joint body 38, circumferentially spaced apart one from another.

Also alternatively, the annular webs 44, 54 of the respective fan rotor 14 and boost compressor 16 may be replaced by any suitable mounting apparatus of the respective fan rotor 14 and boost compressor 16.

The above description is meant to be exemplary only, and one skilled in the art will recognize that changes may be made to the embodiments described without departure from the scope of the described subject matter. For example, the schematically illustrated turbofan gas turbine engine is an exemplary application of the described subject matter and the described subject matter may also be applicable in gas turbine engines of various types. Still other modifications which fall within the scope of the described subject matter will be apparent to those skilled in the art, in light of a review of this disclosure, and such modifications are intended to fall within the appended claims.

The invention claimed is:

1. A gas turbine engine having at least one spool assembly, the at least one spool assembly comprising a fan rotor, a compressor disposed downstream of the fan rotor, a turbine and a shaft connecting the fan rotor, compressor and turbine, a joint having first and second links firmly fixed to an upstream end of the shaft, the first link being connected to the fan rotor by means of first fasteners and the second link being connected to the compressor, by means of second fasteners, the second link being less rigid than the first link wherein the first link comprises an annular front leg extending generally radially outwardly from the shaft, and wherein the second link comprises an annular rear leg extending generally radially outwardly from the shaft.

2. The gas turbine engine as defined in claim 1 wherein the joint comprises an annular body extending radially and outwardly from the upstream end of the shaft, the front leg expanding frustoconically forwardly from the annular body of the shaft end, and the rear leg expanding frustoconically rearwardly from the annular body of the shaft end.

3. The gas turbine engine as defined in claim 2 wherein the annular body with the annular front and rear legs comprises a substantial Y-shaped cross section.

4. The gas turbine engine as defined in claim 2 wherein the annular front leg has a thickness greater than a thickness of the annular rear leg.

5. The gas turbine engine as defined in claim 2 wherein the annular front leg is shorter than the annular rear leg.

6. The gas turbine engine as defined in claim 2 wherein the annular body has a thickness greater than a thickness of either the annular front or rear leg.

7. The gas turbine engine as defined in claim 2 wherein the joint is integrated with the shaft to form an integral part of a single-piece shaft.

8. The gas turbine engine as defined in claim 2 wherein the annular front leg defines a plurality of holes receiving respective fasteners axially extending therethrough to secure the fan rotor to the annular front leg.

9. The gas turbine engine as defined in claim 2 wherein the annular rear leg defines a plurality of holes receiving respective fasteners axially extending therethrough to secure the compressor to the annular rear leg.

10. The gas turbine engine as defined in claim 1 wherein the fan rotor comprises a rearwardly and inwardly extending annular web connected to the first link of the joint and wherein the compressor comprises a forwardly and inwardly extending annular web connected to the second link of the joint.

11. The gas turbine engine as defined in claim 10 wherein the web of the fan rotor has a thickness greater than a thickness of the web of the compressor.

12. The gas turbine engine as defined in claim 10 wherein the annular web of the fan rotor comprises a flange extending radially and inwardly from a rear end of the annular web, the flange defining a plurality of holes receiving respective fasteners extending axially therethrough to secure the first link of the joint to the annular web of the fan rotor.

13. The gas turbine engine as defined in claim 10 wherein the annular web of the compressor comprises a flange extending radially and inwardly from a front end of the annular web, the flange defining a plurality of holes receiving respective fasteners extending axially therethrough to secure the second link of the joint to the annular web of the compressor.

14. A gas turbine engine having at least one spool assembly, the at least one spool assembly comprising a fan rotor, a compressor disposed downstream of the fan rotor, a turbine and a shaft connecting the fan rotor, compressor and turbine, means firmly fixed to an upstream end of the shaft being connected to the fan rotor by means of first fasteners in a first link and connecting being connected to the compressor by means of second fasteners in a second link, the second link being less rigid than the first link.

15. A method for disassociating a fan rotor deflection from a compressor deflection during an undue imbalance event of a fan rotor in a gas turbine engine, the method comprising:

a) firmly fixing a fan rotor to an engine shaft by a first link, the link frustoconically extending outwardly of an upstream end of the shaft; and b) firmly fixing a compressor to the engine shaft by a second link, the second link frustoconically extending outwardly of the upstream end of the shaft, the second link being less rigid than the first link.

16. The method as defined in claim 15 wherein steps (a) and (b) are achieved by a joint firmly fixed to the upstream end of the shaft, the joint having the first and second links with a joint body to form a single-piece component having a substantially Y-shaped cross section.

* * * * *